United States Patent [19]

Aslan et al.

[11] 4,195,211

[45] Mar. 25, 1980

[54] SINGLE POLE TRIP AND GANGED POLE CLOSING FOR MULTIPHASE HIGH-VOLTAGE POWER CIRCUIT BREAKERS

[75] Inventors: Wilfred A. Aslan, Seal Beach; Giovanni P. Guaglione, Irvine; James R. McCloud, Anaheim; Henry G. Meier, Glendale, all of Calif.

[73] Assignee: I-T-E Imperial Corporation, Spring House, Pa.

[21] Appl. No.: 697,332

[22] Filed: Jun. 18, 1976

[51] Int. Cl.[2] ..... H01H 3/00

[52] U.S. Cl. ..... 200/153 D; 200/50 C; 200/148 F; 200/148 B; 335/166

[58] Field of Search ..... 200/148 B, 148 F, 153 D, 200/148 R, 50 C; 335/8, 9, 10, 166

[56] References Cited

U.S. PATENT DOCUMENTS

| | | | |
|---|---|---|---|
| 2,573,256 | 10/1951 | Forwald | 200/148 R |
| 3,391,358 | 7/1968 | Bratkowski | 200/148 R |
| 4,123,635 | 10/1978 | Rostron | 200/148 F |

*Primary Examiner*—Robert S. Macon

*Attorney, Agent, or Firm*—Ostrolenk, Faber, Gerb & Soffen

[57] ABSTRACT

A high-voltage power circuit breaker contains a plurality of phases which are contained in respective separate tanks which may be filled with sulfur hexafluoride. Each phase contains a respective trip-free contact operating mechanism connected to the interrupter contacts within the tank. Each of the trip-free operating mechanisms are closed simultaneously by a pneumatic closing mechanism contained in only one of the poles and connected to the other pole operating mechanisms by a common operating rod. Each of the poles are simultaneously closed by the pneumatic operating mechanism, and each pole can open independently of the other poles through its own trip-free operating mechanism.

10 Claims, 2 Drawing Figures

SINGLE POLE TRIP AND GANGED POLE CLOSING FOR MULTIPHASE HIGH-VOLTAGE POWER CIRCUIT BREAKERS

BACKGROUND OF THE INVENTION

This invention relates to high-voltage high-power multiphase circuit breakers, and more particularly relates to a novel operating mechanism for such circuit breakers which enables ganged closing and individual opening of each of the poles or phases of the breaker. In the event that one of the poles is "stuck closed", the individual opening feature enables the other poles to open. A stuck-closed phase can be caused by any of numerous conditions including welding of contacts of interrupters, breakage or jamming of parts of the interrupter or breaker, and the like. If for some reason, one of the breaker phases cannot open, and also prevents the other two phases from opening, the chance of escalating a single line-to-ground fault into a multiphase fault is greatly increased.

High-power high-voltage circuit breakers of the type to which the present invention applies are well known in the art, and are typically shown in U.S. Pat. Nos. 3,836,741 (PC-94), 3,879,591 (PC-170), 3,885,114 (PC-166) and 3,889,083 (PC-165), each of which are owned by the assignee of the present invention and which are incorporated herein by reference. In breakers of this type, it is common to provide a single operating mechanism which is contained in a housing secured to one of the phases. An operating rod extends from the single operating mechanism to each of the breaker phases for operating all phases from the single operating mechanism. Thus, each breaker phase is simultaneously opened and closed through the single operating mechanism and interconnected operating rod. This arrangement permits the substantial simultaneous closing of each breaker phase, which is necessary for the power transmission system stability.

High-power circuit breakers have also been designed in the past with each phase or pole having its own operating mechanism for both closing and opening the phase. Thus, each phase can be independently tripped so that, if one phase is stuck closed, the other two phases can still open, thereby decreasing the chance that a line-to-ground fault will escalate to a multiphase fault which would, in turn, cause a major system outage. These independent poles are also arranged to close at the same time, but experience has shown that, because of the added parts in the closing systems, such as closing anti-pump relays, solenoid-operated, pneumatic or hydraulic valves, and the like, plus the different travelling times of the breaker contacts of different phases from open to closed positions, there is an erratic pole spread upon closing. This pole spread is deleterious to the system stability due to overvoltages during closing of the breaker in a high-voltage high-power system.

BRIEF DESCRIPTION OF THE INVENTION

In accordance with the present invention, each phase of a multiphase high-voltage high-power circuit breaker is provided with its own trip-free contact operating mechanism. A single main closing member is then arranged at one of the poles and a common mechanical operating rod extends from this single closing mechanism to the trip-free mechanisms of each phase. Consequently, with the novel system of the invention, each pole of the breaker is mechanically interconnected for ganged closing, while each pole can individually open independently of the other phases so that a stuck phase will not prevent the other phases of the breaker from opening.

The present invention is particularly applicable to extremely high-power electrical utility systems which require two-cycle interrupting and switching surge control to increase the system stability. High-speed reclosing of the circuit breaker also adds to the power transmission system reliability.

The present invention permits simultaneous three-pole high-speed reclosing of the breaker while permitting the individual opening of the various phases to prevent a stuck phase from keeping the other phases closed.

DETAILED DESCRIPTION OF THE DRAWINGS

Figure 1:
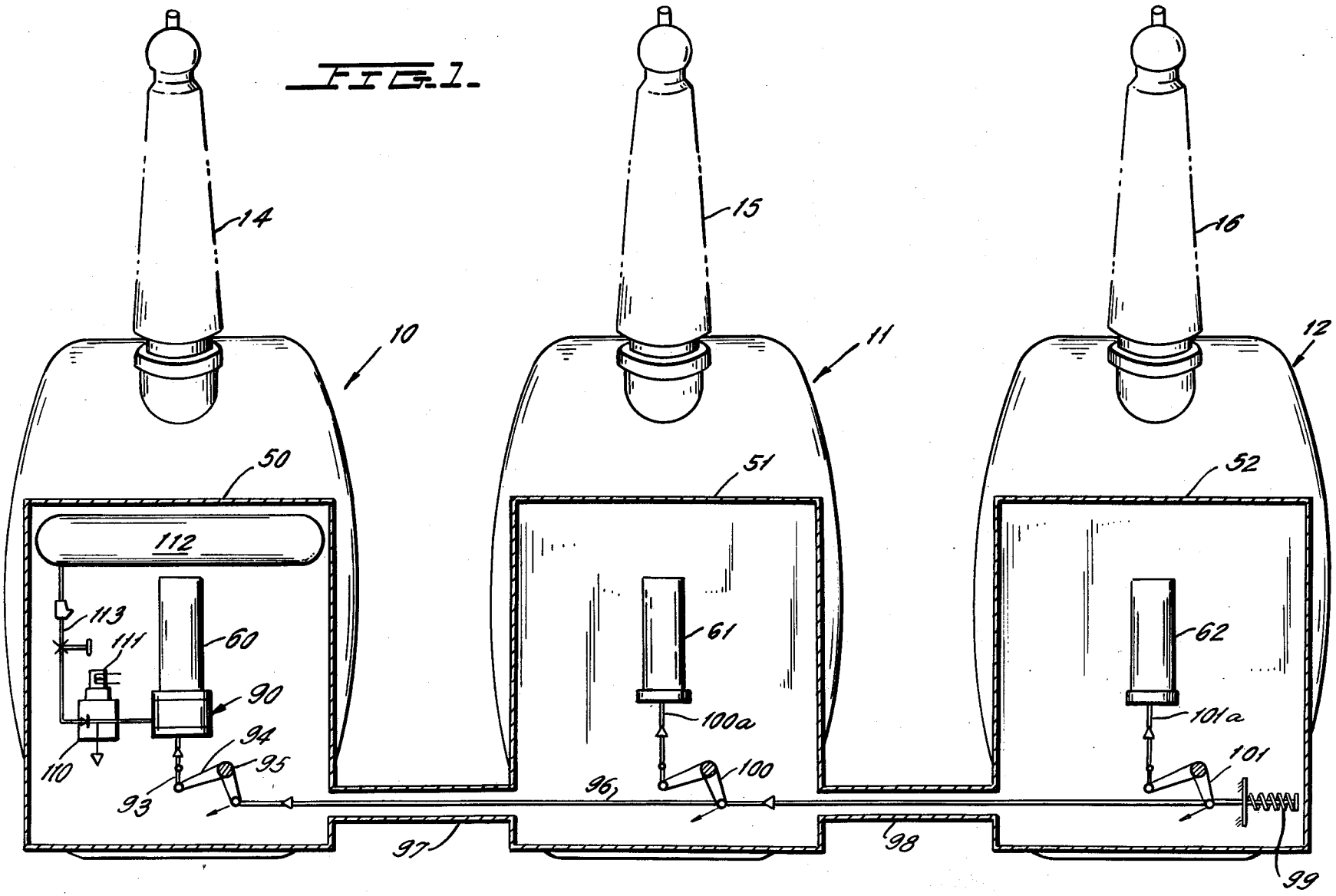
FIG. 1 is an elevational view of three poles of a circuit breaker which contains the novel operating mechanism of the present invention.

Referring now to the drawings, there is illustrated a conventional three-phase high-voltage $SF_6$ breaker which may be of the type of any of the aforementioned U.S. patents, where the breaker incorporates the novel operating mechanism of this invention which permits single-pole opening of any of the poles with three-pole ganged closing. Note that, while the invention is illustrated in connection with a two-pressure $SF_6$ type breaker, the invention is also applicable to other types of power circuit breakers such as gas blast breakers, oil breakers, and the like.

Figure 2:
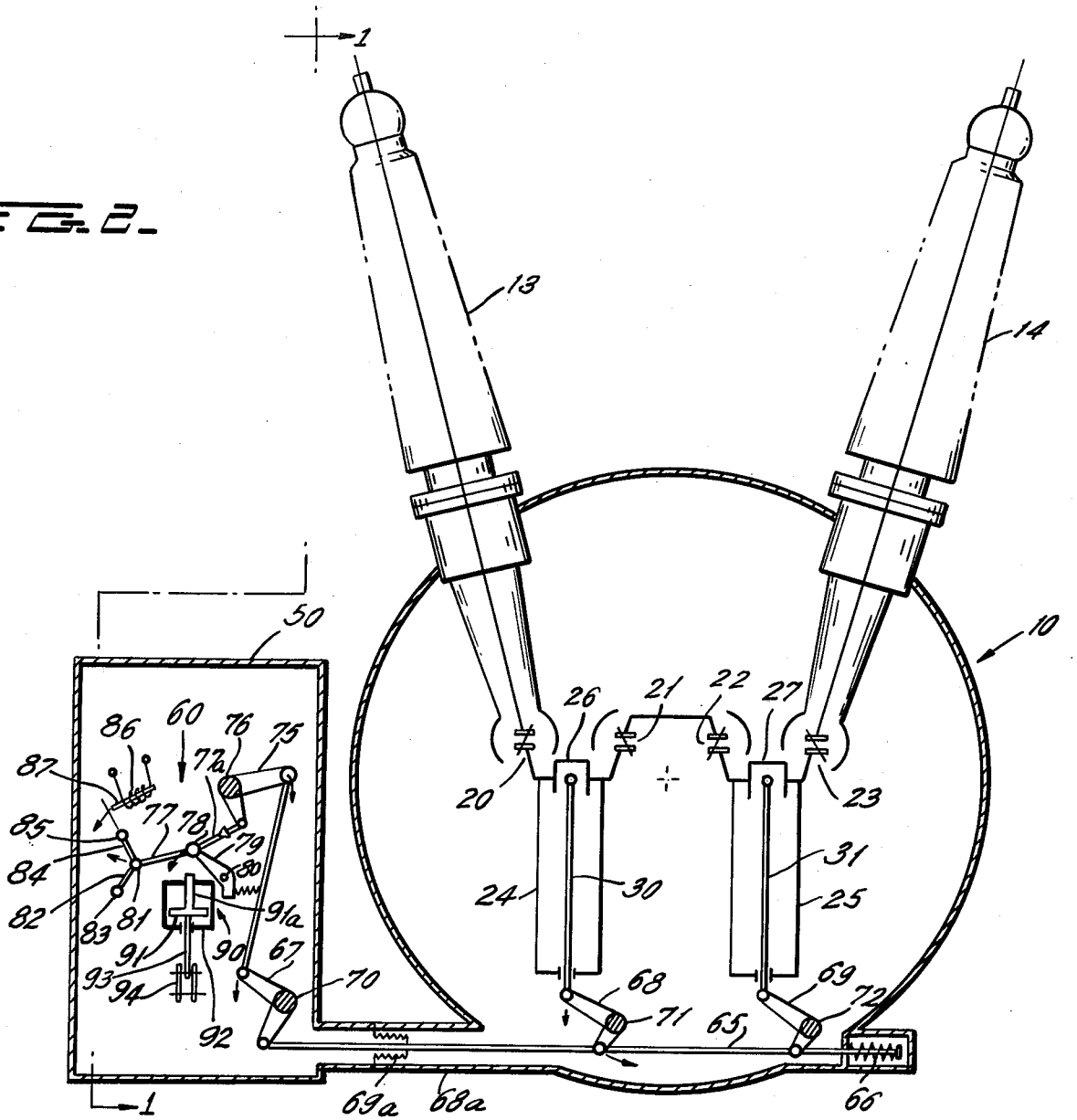
FIG. 2 is a schematic cross-sectional view through one of the phases of FIG. 1.

The circuit breaker of FIGS. 1 and 2 contains three phases 10, 11 and 12 where each of the three phases contains a pair of conventional entrance bushings, shown as bushings 13 and 14 in FIG. 2. Only one of the pair of bushings for each phase is seen in FIG. 1 including bushings 14, 15 and 16 for phases 10, 11 and 12, respectively. Note that each of the phases 10, 11 and 12 may be in separate tanks as shown, or in a common tank.

Each of the phases 10, 11 and 12 contain an interrupter mechanism supported within low-pressure sulfur hexafluoride. FIG. 2 schematically illustrates series-connected interrupter contacts 20, 21, 22 and 23 which are connected in series with one another and with bushings 13 and 14. The interrupter contacts 20 to 23 are then supported atop the schematically illustrated high-pressure $SF_6$ containers 24 and 25, which are equipped with the schematically illustrated blast valves 26 and 27. The details of this construction are well known to those skilled in the art and may be seen in the U.S. patents referred to hereinabove, the disclosures of which have been incorporated herein by reference.

The blast valve 26 and contacts 20 and 21 are connected to interrupter contact operating rod 30, while the blast valve 27 and contacts 22 and 23 are connected to the interrupter contact operating rod 31. Operating rods 30 and 31 are axially movable rods and operate such that, when the rods are lowered, they cause the opening of their respective blast valves 26 and 27 and the opening of their respective contacts 20–21 and 22–23, which open in the presence of a blast of electronegative gas which assists in the extinguishing of arcs drawn between the separating contacts. Suitable means are provided to terminate the flow of gas from the chambers 24 and 25 after the contacts 20 to 23 are opened. When the operating rods 30 and 31 are moved upward, they cause the closing of their respective contacts 20–21 and 22–23.

An identical arrangement of interrupters, high-pressure containers and contact operating rods are provided for phases 11 and 12, as are shown for phase 10 in FIG. 1.

In accordance with the present invention, each of the phases 10, 11 and 12 of FIGS. 1 and 2 are provided with respective trip-free contact operating mechanism housings 50, 51 and 52, which are mechanically interconnected, as will be later described to enable ganged closing of all phases.

Each of the operating mechanisms 50, 51 and 52 include identical trip-free linkages contained within casings 60, 61 and 62 of FIG. 1 where the trip-free linkage within casing 60 is shown in detail in FIG. 2. The operating mechanism is connected to operating rods 30 and 31 for contacts 20 to 23 of phase 10 of FIG. 2 by means of an axially movable pull rod 65 which is urged to the right in FIG. 2 by a compression spring 66. Pull rod 65 is pivotally connected to bell crank 67 within housing 50 and bell cranks 68 and 69 within the low-pressure tank housing for phase 10. Rod 65 extends through a tubular conduit 68*a* which is sealed by a bellows 69 to prevent communication of the low-pressure $SF_6$ gas within the housing of the phase 10 from leaking into the operating mechanism housing 50.

Each of bell cranks 67, 68 and 69 are rotated on fixed pivots 70, 71 and 72, respectively. Crank 67 is then connected to a crank 75 which is pivotally mounted on fixed pivot 76. The crank 75 is then pivotally connected to toggle links 77 and 77*a*, which are pivotally connected and which carry a latch roller 78. Latch roller 78 acts as a conventional prop latch and is latched on the non-trip-free prop latch 79 which is pivotally mounted on the fixed pivot 80.

The left-hand end of link 77 terminates in a roller latch 81 and is pivotally connected to pivot link 82 which is pivotally mounted on the fixed pivot 83. The roller 81 may then be latched by the trip latch 84 which is pivotally mounted on fixed pivot 85 and which is operated by a conventional trip coil 86 which can eject the plunger 87 in order to rotate trip latch 84 in a counterclockwise direction to release the roller 81.

As pointed out previously, mechanisms identical to the above-described mechanism are provided for each of phases 10, 11 and 12 and are contained within casings 60, 61 and 62 of housings 50, 51 and 52, respectively.

In order to close the breaker phases, only a single closing mechanism is provided. This closing mechanism is contained within housing 50 of phase 10 of the breaker and consists of a pneumatically operated closing ram 90 which, as shown in FIG. 2, contains an air piston 91 movable within cylinder 92. Piston 91 has an upper extension 91*a*, which is engageable with roller 78 when the toggle links 77 and 77*a* are collapsed downwardly, and the contacts 20 and 23 are open.

The piston 91 has a downwardly extending shaft 93 which is connected to the bell crank 94 which is pivotally mounted, as seen in FIG. 1, on the fixed pivot 95. In accordance with an important feature of the invention, the bell crank 94 is connected to a pull rod 96, as shown in FIG. 1, which extends through conduits 97 and 98 which interconnect housings 50, 51 and 52. The end of rod 96 is connected to a piston return spring 99 in housing 12 which biases pull rod 96 to the right. Spring 99 operates to reset the closing piston and linkages as quickly as possible after the breaker is closed to permit high-speed reclosing.

In accordance with the invention, operating rods 100*a* and 101*a* are provided for the mechanisms within housings 61 and 62, and serve the same purpose of extension 91*a* of piston 91 in housing 50. Thus, operating rods 100*a*and 101*a* are engageable with the roller corresponding to roller 78 in the operating mechanism for phases 11 and 12. Rods 100*a* and 101*a* are connected to pull rod 96 by pivotally mounted bell cranks 100 and 101.

The closing air ram 90 within housing 50 is operated by a conventional air valve 110 (FIG. 1) which can be controlled from a valve-operating coil 111 to admit air from a high-pressure air tank 112, through air line 113, into the closing ram 90 when the breaker is to be closed.

The air control system also includes a three-way valve and suitable controls therefor to enable the release of pressure from beneath piston 91 after the breaker contacts are closed.

The operation of the mechanism of the invention is as follows:

When the interrupter contacts are closed, all parts are in the position shown in FIG. 2. The pull rod 65 is being urged to the right by the opening spring 66, but this rightward motion of the pull rod 65 and thus the counterclockwise rotation of links 68 and 69 is resisted by the setting of latches 79 and 84 which maintain latch rollers 81 and 78 in the position shown.

In order to open all or any of the breaker phases, for example, phase 10, a suitable signal is applied to the three tripping solenoids 86 of each respective phase. The solenoid plunger 87 will then rotate the trip latch 84 in a counterclockwise direction, thereby releasing roller 81. This permits links 77 and 77*a* to move to the left and permits roller 78 to move off latch 79 and the collapse of toggle links 77–77*a* until roller 78 seats on top of extension 91*a*. This action permits the clockwise rotation of crank 76 and thus the counterclockwise rotation of cranks 67, 68 and 69 under the influence of opening spring 66, thereby to move operating rods 30 and 31 downwardly to open the breaker.

Note that this operation for each phase 10, 11 and 12 is independent of each other phase, so that, if one breaker phase is stuck closed, the other two can still open. Note further that the mechanism is trip-free since, if a phase closes on a fault, trip latch 84 is operated and prop latch 79 is reset. The phase cannot now be reclosed until the trip latch 84 is reset.

In order to close the breaker, each phase is simultaneously closed in a ganged manner. Closing valve 110 is operated to cause high-pressure air from cylinder 112 to be admitted into the closing air ram beneath piston 91. Piston 91 then moves upwardly and straightens the toggle links 77–77*a* by pressing upwardly on roller 78 until roller 78 seats on prop latch 79. Note that the trip latch 84 is set so that the left-hand end of toggle link 77 cannot move to the left. The straightening of the toggle links 77–77*a* causes the rotation of bell crank 75 in a counterclockwise direction, thereby to rotate bell crank 67 in a clockwise direction, thus pulling pull rod 65 to the left. This moves rods 30 and 31 upwardly to close the interrupter contacts 20 to 23 of phase 10.

In accordance with the invention, the bell crank 94 also operates bell cranks 100 and 101 in phases 11 and 12 so that the rods 100*a* and 101*a*in FIG. 1 move up to operate rollers, similar to roller 78 of the operating mechanisms of phases 11 and 12, in a manner identical to that of the piston extension 91*a* of the mechanism 60 of FIGS. 1 and 2. Thus, the upward movement of rods 100*a* and 101*a* will cause the straightening of respective toggle linkages of mechanisms 61 and 62, thereby to cause the closing of the interrupter contacts within interrupters 11 and 12 in a manner identical to that previously described for phase 10, with all contacts of all phases closing simultaneously.

After closing the breaker contacts, a suitable control circuit (not shown) de-energizes the closing solenoid 111, to shut off three-way valve 110, to shut off air from air tank 112 and to allow the escape of high-pressure air from beneath the closing air ram 90. Spring 99 then returns the linkage to the positions shown in FIGS. 1 and 2.

Although the present invention has been described in connection with preferred embodiments thereof, many other variations and modifications will now become apparent to those skilled in the art. It is preferred, therefore, that the present invention be limited not by the specific disclosure herein, but only by the appended claims.

The embodiments of the invention in which an exclusive privilege or property is claimed are defined as follows:

1. A high-voltage three-phase circuit breaker for a high-power electrical transmission system; said circuit breaker having separate tanks for containing each of the three circuit breaker phases; each of said three circuit breaker phases including contact interrupter means disposed within their respective tank and terminal bushings extending through the wall of each tank and connected to a respective contact interrupter means; each of said contact interrupter means being movable between a closed position and an open position; a respective contact operating mechanism for each of said contact interrupter means; each of said contact operating mechanisms of each of said three phases comprising a trip-free linkage connected to their respective said contact interrupter means and being adapted to hold their said respective contact operating mechanism in their said closed position; biasing means connected to each of said contact interrupter means to bias each of said contact interrupter means to their said open position; respective trip means for each of said trip-free linkages of each of said three phases to enable the individual opening of said contact interrupter means of any of said phases independently of any of the other phases; and a single mechanical ganged closing mechanism mechanically connected to each of said trip-free linkages of each of said three phases, and operable to move each of said contact interrupter means to their said closed position in response to the operation of said single closing mechanism with minimum pole spread.

2. The circuit breaker of claim 1 which further includes a separate operating mechanism housing for each of said contact operating mechanisms; each of said operating mechanism housings being mounted adjacent said tank of their said respective phase; each of said operating mechanism housings containing said respective trip-free linkage and biasing means for its respective phase; said single ganged closing means being contained in only one of said operating mechanism housings.

3. The circuit breaker of claim 2 wherein said single ganged closing means includes a pneumatically operable piston applicable directly to said trip-free mechanism in said mechanism housing containing said single ganged closing means, and pull rod connection means connecting said piston to the other said trip-free mechanisms in the other mechanism housings.

4. The circuit breaker of claim 2 which further includes first pull rod connection means extending between said mechanism housings and said tank of a respective phase, and from said trip-free linkages to their respective said contact interrupter means respectively and second pull rod connection means extending between said mechanism housings, and from said mechanism housing containing said ganged closing mechanism to said trip-free mechanisms of the other of said mechanism housings.

5. The circuit breaker of claim 1 wherein each of said tanks is filled with an electronegative gas at a pressure above atmospheric pressure.

6. The circuit breaker of claim 4 wherein each of said tanks is filled with an electronegative gas at a pressure above atmospheric pressure.

7. The circuit breaker of claim 6 which further includes gas sealing means on said first pull rod connection means to prevent leakage of gas from the region where said first pull rod connection means enter their said respective tank.

8. An operating mechanism for a two-cycle three-phase high voltage circuit breaker for use in a high-voltage power transmission system; said operating mechanism comprising respective and individually operable trip-free mechanisms for each phase of said circuit breaker for allowing individual opening of each of said phases, and a ganged close mechanism mechanically connected to each of said trip-free mechanisms and operable to close each of the phases of said circuit breaker with minimum pole spread.

9. A high-voltage three-phase circuit breaker for a high-power electrical transmission system; said circuit breaker having tank means for containing each of the three circuit breaker phases; each of said circuit breaker phases including contact interrupter means disposed within said tank means and terminal bushings extending through wall portions of said tank means and connected to said contact interrupter means; each of said contact interrupter means being movable between a closed position and an open position; a respective contact operating mechanism for each of said contact interrupter means; each of said contact operating mechanisms comprising a trip-free linkage connected to their respective said contact interrupter means and being adapted to hold their said respective contact operating mechanism in their said closed position; biasing means connected to each of said contact interrupter means to bias each of said contact interrupted means to their said open position; respective trip means for each of said trip-free linkages of each of said three phases to enable the individual opening of said contact interrupter means of any of said phases independently of any of the other phases; and a single mechanical ganged closing mechanism mechanically connected to each of said trip-free linkages, and operable to move each of said contact interrupted means to their said closed position in response to the operation of said single closing mechanism with minimum pole spread.

10. The circuit breaker of claim 9 wherein said tank means is filled with an electronegative gas at a pressure above atmospheric pressure.

* * * * *